US007765938B2

(12) United States Patent
Piretti

(10) Patent No.: US 7,765,938 B2
(45) Date of Patent: Aug. 3, 2010

(54) NESTING AND FOLDING TABLE

(75) Inventor: Alessandro Piretti, Bologna (IT)

(73) Assignee: Pro-Cord Spa, Bologna (IT)

( * ) Notice: Subject to any disclaimer, the term of this patent is extended or adjusted under 35 U.S.C. 154(b) by 332 days.

(21) Appl. No.: 12/033,169

(22) Filed: Feb. 19, 2008

(65) Prior Publication Data

US 2008/0196635 A1 Aug. 21, 2008

(30) Foreign Application Priority Data

Feb. 19, 2007 (EP) ..... 07425090

(51) Int. Cl.
*A47B 3/00* (2006.01)

(52) U.S. Cl. ..... 108/115; 108/120

(58) Field of Classification Search ..... 108/118, 108/91, 6, 115, 50.01, 50.02, 120; 280/33.991, 280/33.996, 33.997, 639, 42; 248/164, 166, 248/170, 439

See application file for complete search history.

(56) References Cited

U.S. PATENT DOCUMENTS

| | | | | |
|---|---|---|---|---|
| 2,762,669 | A * | 9/1956 | Watson | 108/91 |
| 5,337,657 | A * | 8/1994 | Diffrient | 108/115 |
| 5,549,055 | A * | 8/1996 | Kusch | 108/159.11 |
| 5,771,815 | A * | 6/1998 | Leftwich | 108/99 |
| 6,082,838 | A * | 7/2000 | Bissu-Palombo | 312/195 |
| 6,314,892 | B1 * | 11/2001 | Favini | 108/115 |
| 6,336,414 | B1 * | 1/2002 | Stewart et al. | 108/50.02 |
| 6,637,352 | B1 * | 10/2003 | Thode et al. | 108/132 |
| 7,066,098 | B2 * | 6/2006 | Blasen et al. | 108/115 |
| 7,246,560 | B2 * | 7/2007 | Shepherd | 108/117 |
| 7,614,351 | B2 * | 11/2009 | Piretti | 108/115 |
| 2007/0137532 | A1 * | 6/2007 | Cromie | 108/57.15 |
| 2007/0209559 | A1 * | 9/2007 | Mockel | 108/115 |

FOREIGN PATENT DOCUMENTS

| | | |
|---|---|---|
| CH | 281701 | 3/1952 |
| DE | 202006003535 | 7/2006 |
| WO | WO 00/10426 | 3/2000 |
| WO | WO 02/102193 | 12/2002 |

OTHER PUBLICATIONS

EP Search Report, Application No. 07425090.2-1258, dated Aug. 3, 2007.

* cited by examiner

*Primary Examiner*—Darnell M Jayne
*Assistant Examiner*—Andres Gallego
(74) *Attorney, Agent, or Firm*—Patterson & Sheridan, L.L.P.

(57) ABSTRACT

Nesting and folding table, comprising a supporting structure including two pairs of legs, a top articulated to the supporting structure about a horizontal axis and mobile between a position of use and a position of storage, and a pair of supporting devices each including an arched guide fixed with respect to the top, a rotatable arm, and a supporting member, carried by the rotatable arm and slidably engaging said arched guide. The first and the second pairs of legs are both fixed to one another and are staggered with respect to one another in a direction parallel to the axis of rotation of the surface. Said arm has a first end that rotatably engages an end of a respective leg and a second end that is connected to said supporting member by means of a joint, designed to enable a movement of rotation of the supporting member with respect to said second end of the arm about at least two mutually orthogonal axes.

11 Claims, 12 Drawing Sheets

NESTING AND FOLDING TABLE

CROSS-REFERENCE TO RELATED APPLICATIONS

This application claims benefit of European patent application number 07425090.3, filed Feb. 19, 2007, which is herein incorporated by reference.

BACKGROUND OF THE INVENTION

1. Field of the Invention

The present invention relates to a nesting and folding table, comprising:

a supporting structure including two pairs of legs;

a top articulated to the supporting structure about a horizontal axis and mobile between a position of use and a position of storage; and a pair of supporting devices, each including an arched guide fixed with respect to the top, a rotatable arm, and a supporting member carried by said arm and slidably engaging said arched guide.

2. Description of the Related Art

A table having the characteristics forming the subject of the preamble of claim 1 is known from the document No. WO 00/10426, which discloses a table having a top that can rotate about a horizontal axis and a supporting structure including two vertical legs that can rotate about respective vertical axes. The legs are displaceable between a position of use and a position of storage. The top is connected to the rotating legs by means of two supporting devices, each of which comprises an arched guide fixed with respect to the top and an arm connected to the rotating legs. In the position of storage, the table can be nested with other tables of the same type.

SUMMARY OF THE INVENTION

The object of the present invention is to provide a nesting table having a simple, sturdy structure, made up of a small number of components that can be assembled in a simple and fast way.

In the solution according to the present invention, the first and second pairs of legs are both fixed to one another and are staggered with respect to one another in a direction parallel to the axis of rotation of the surface so as to enable reciprocal nesting between the tables without any need to rotate the legs between an operative position and an inoperative position. The top of the table is associated to two supporting devices, each of which comprises an arm with a first end that rotatably engages one end of a respective leg and a second end that is connected to a supporting member by means of a joint, designed to enable a movement of rotation of the supporting member with respect to the second end of the arm about at least two mutually orthogonal axes.

The solution according to the present invention enables blocking of the table top in the position of use to be obtained in a particularly simple way.

BRIEF DESCRIPTION OF THE DRAWINGS

Further characteristics and advantages of the present invention will emerge clearly in the course of the ensuing detailed description, provided purely by way of non-limiting example with reference to the annexed drawings, in which.

DETAILED DESCRIPTION

Figure 1:
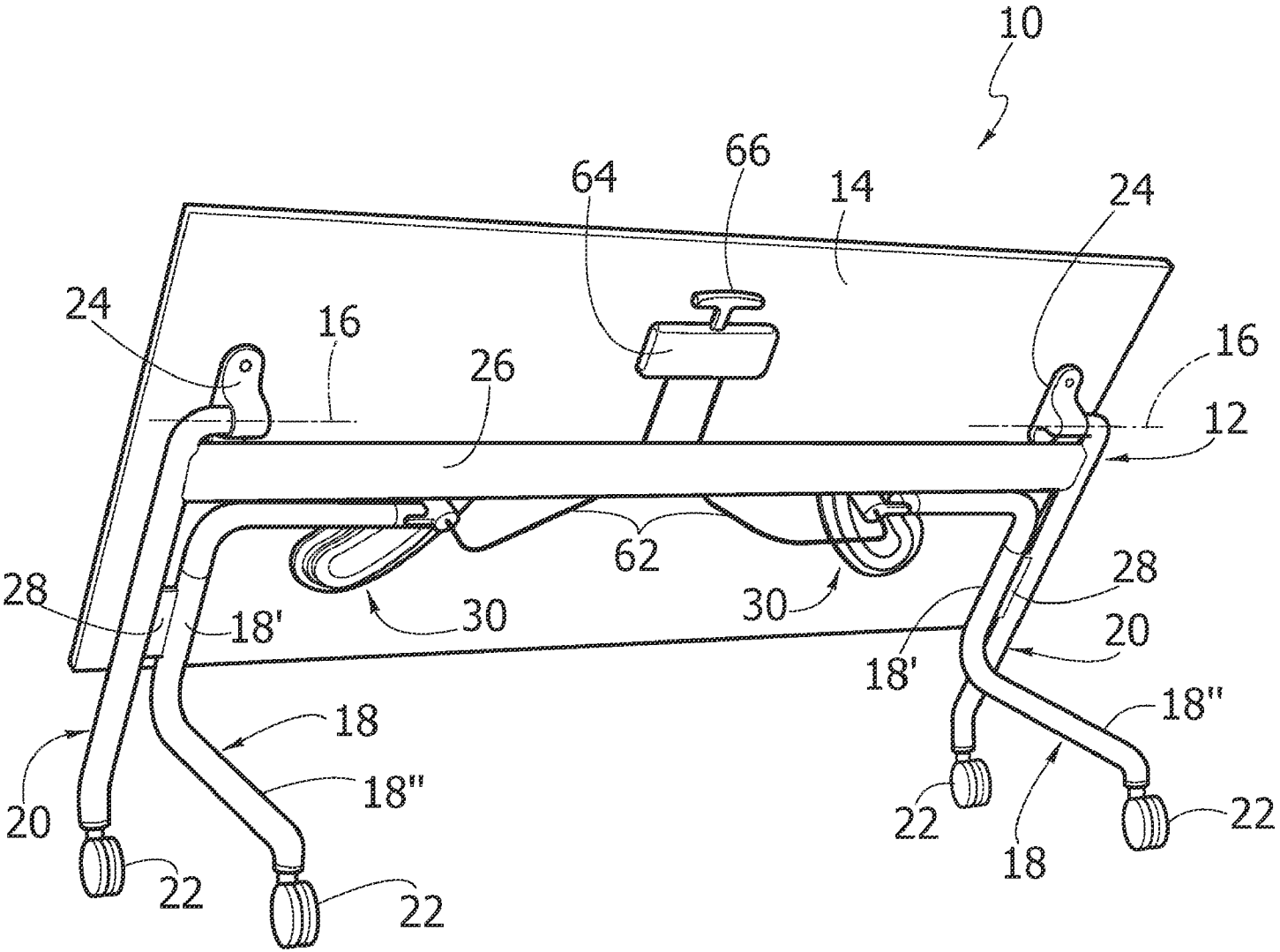
FIGS. 1 and 2 are perspective views illustrating the table according to the present invention in a position of storage and in a position of use, respectively.
Figure 2:
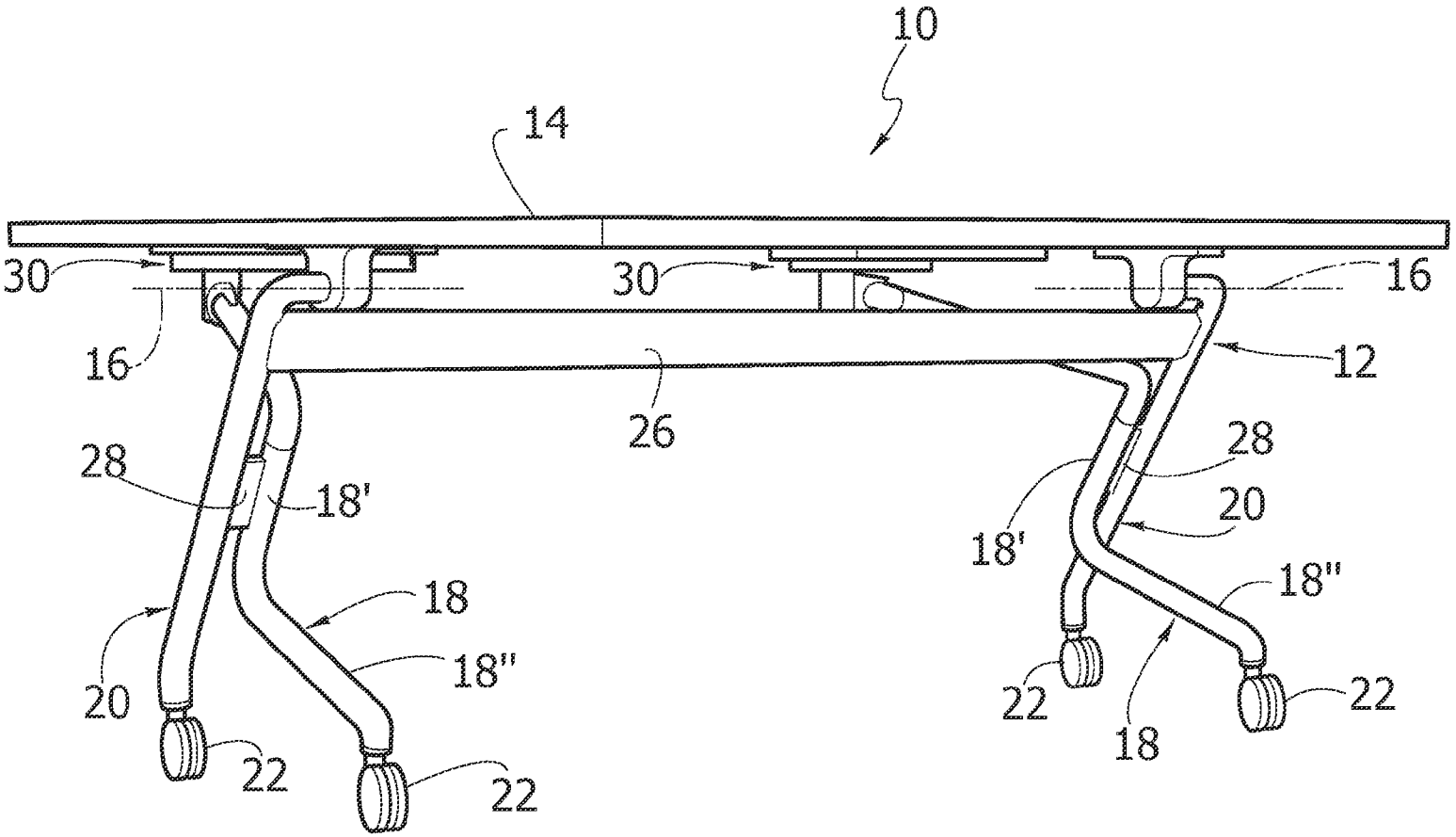
Figure 3:
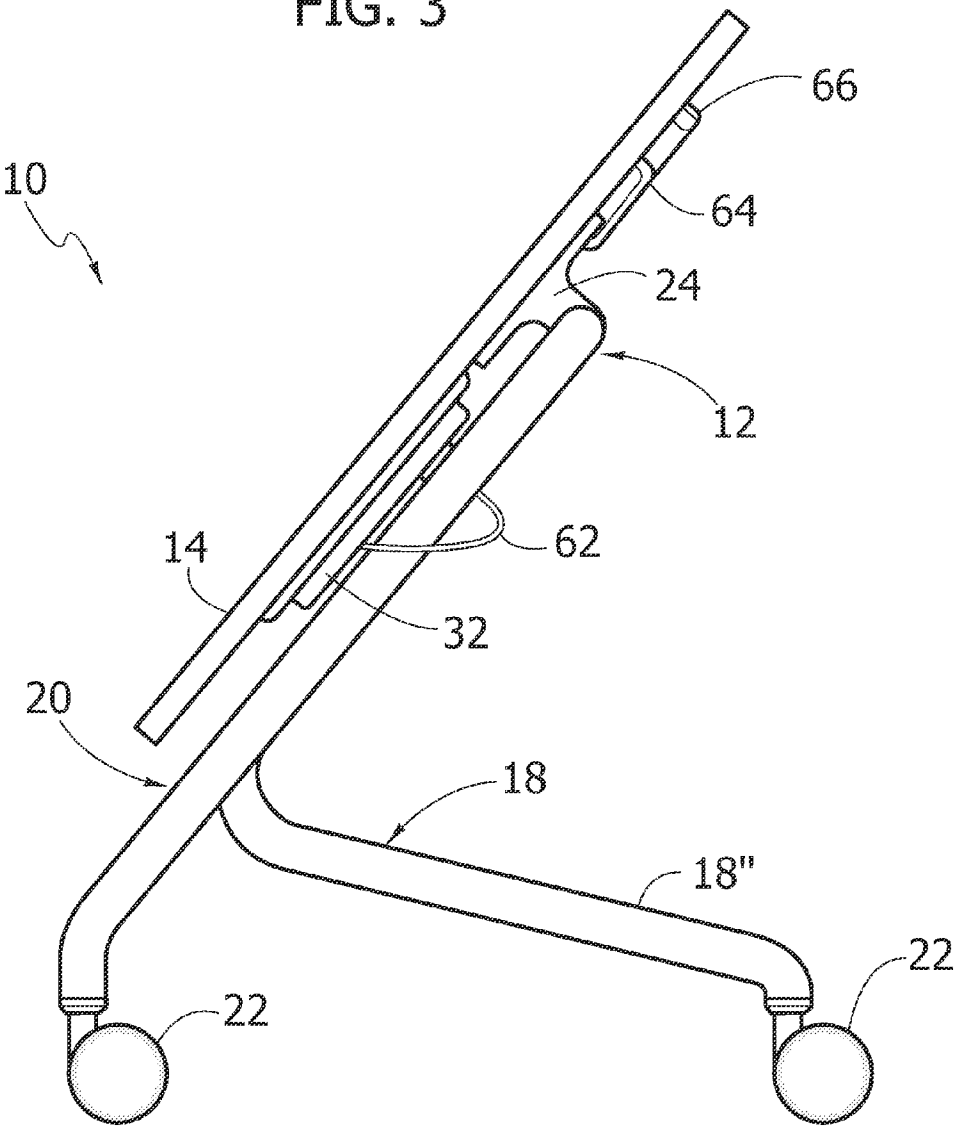
FIGS. 3 and 4 are side views illustrating the table according to the invention in a position of storage and in a position of use, respectively.

With reference to FIGS. 1 to 6, designated by 10 is a table according to the present invention. The table 10 comprises a supporting structure 12 and a top 14, which is articulated to the supporting structure 12 about a horizontal axis 16 and is mobile between a position of storage illustrated in FIGS. 1, 3 and 5 and a position of use, illustrated in FIGS. 2, 4 and 6.

In the embodiment illustrated in the figures, the top 14 has a rectangular shape. However, the present invention is applicable to tables provided with tops with any shape, for example square, oval, circular, etc.

The supporting structure 12 comprises two pairs of legs 18, 20 preferably provided at their bottom ends with pivot wheels 22. The legs 18, 20 are staggered with respect to one another in the direction of the axis of rotation 16 of the top 14. The legs 20 are in a position laterally external with respect to the legs 18.

The two external legs 20 have respective central portions co-planar to one another, which extend in a direction inclined by an acute angle with respect to a vertical plane. The top ends of the two external legs 20 are articulated to respective supports 24 fixed to the underside of the top 14. The axes of articulation between the supports 24 and the top ends of the external legs 20 are coaxial to one another and define the axis of rotation 16 of the top 14.

The internal legs 18 each have a top portion 18' and a bottom portion 18", inclined by an acute angle with respect to the top portion 18'. The top portion 18' of the legs 18 is parallel to the inclined part of the external legs 20. The bottom portion 18" is inclined in the opposite direction with respect to the corresponding external leg 20. The bottom portion 18" is inclined by an acute angle with respect to a horizontal plane. The wheels 22 of the legs 18, 20 extend on opposite sides with respect to a vertical plane passing through the axis of rotation 16 of the top 14.

The two external legs 20 are fixed with respect to one another by means of a horizontal beam 26 parallel to the axis of rotation 16. Each internal leg 18 is fixed to the corresponding external leg 20, for example by means of a fixing element 28. The legs 18, 20 are preferably constituted by bent tubular metal elements. The reciprocal fixing between the legs 18, 20 and between the legs 20 and the horizontal beam 26 is obtained by welding or by means of screws.

Figure 7:
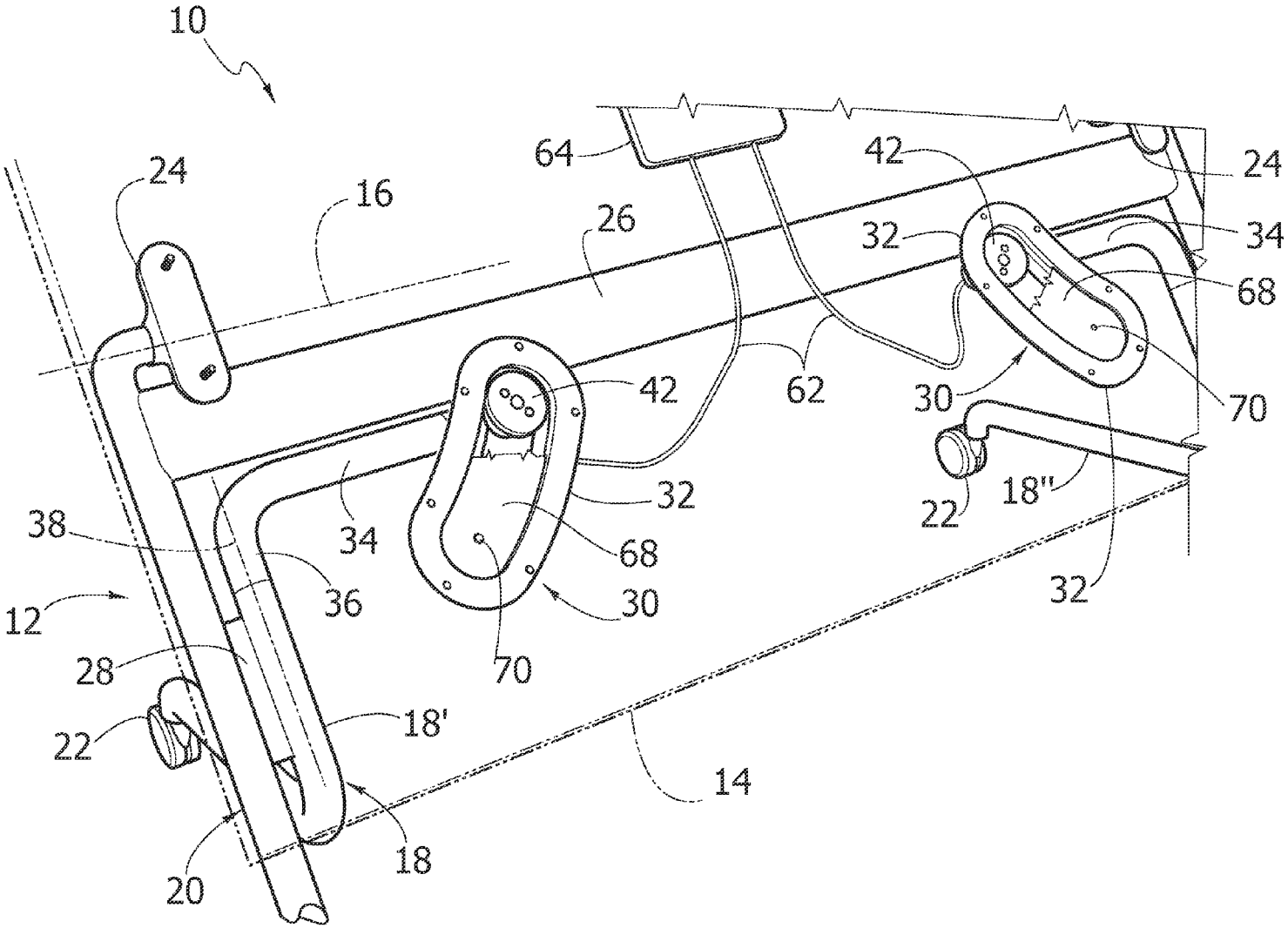
FIGS. 7 and 8 are partial perspective views of the table according to the invention in a position of storage and in a position of use, respectively, with the top represented in transparency.
Figure 8:
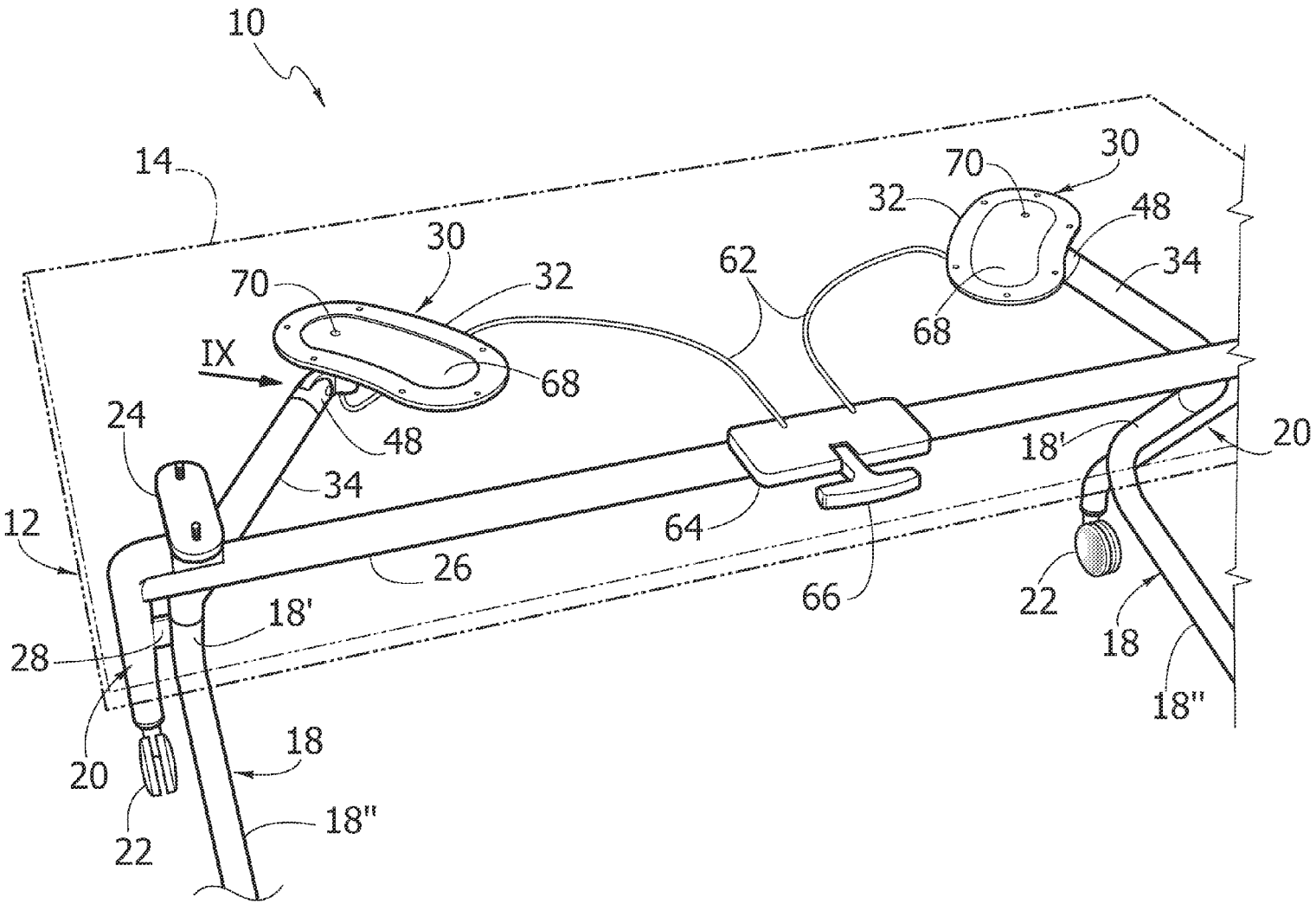
Figure 9:
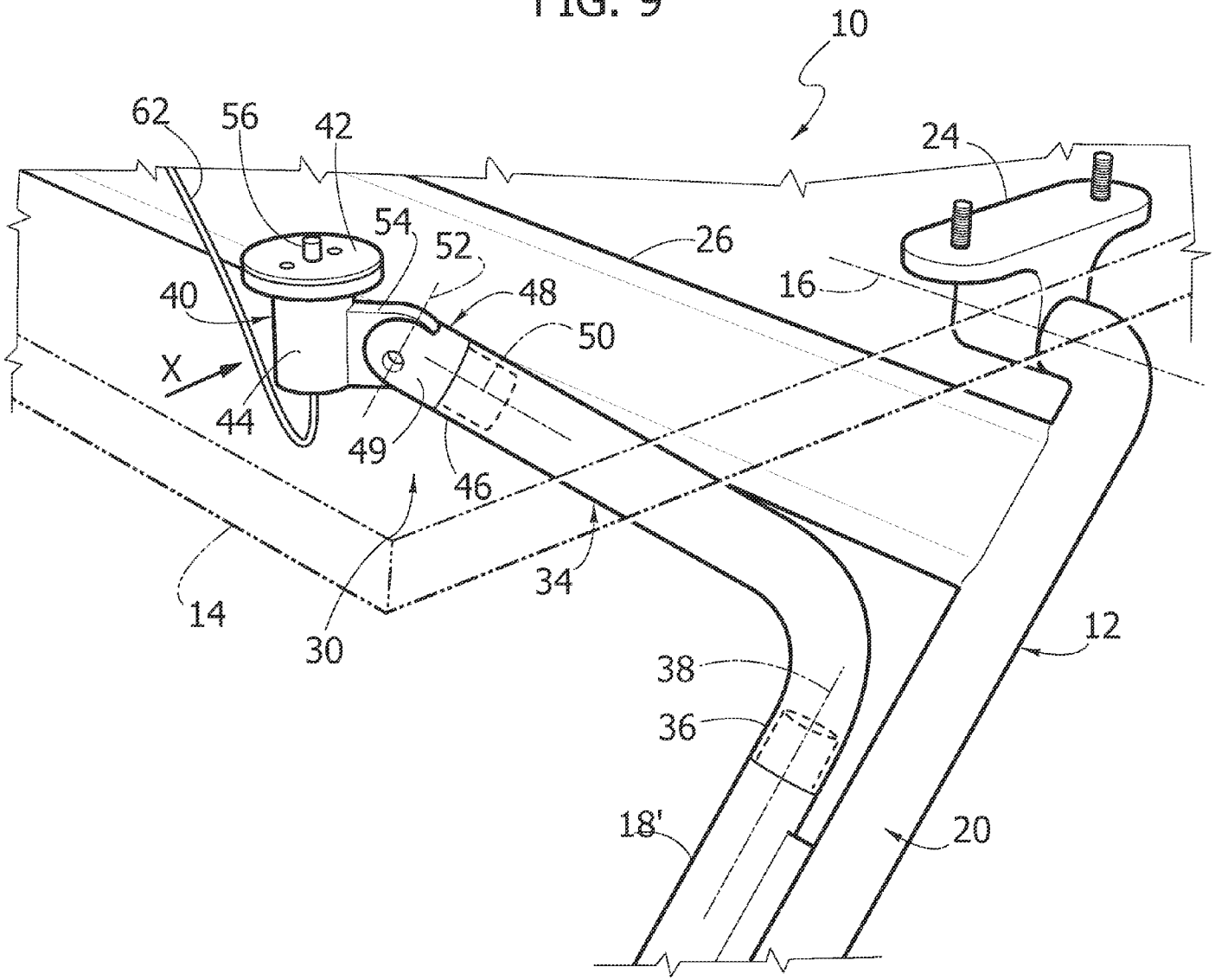
FIG. 9 is a perspective view of the part indicated by the arrow IX in FIG. 8.

With reference to FIGS. 7, 8 and 9, the table 10 comprises two supporting devices 30, each of which comprises an arched guide 32 and an arm 34. The arched guides 32 are fixed on the underside of the top 14. Each guide 32 defines a guide path with an arched shape contained in a plane parallel to the top 14. The guide path has two end-of-travel positions corresponding to the positions of storage and of use of the top 14.

With reference in particular to FIG. 9, the arm 34 of each supporting device 30 has a first end 36 that is mounted rotatable about an axis 38 with respect to the top portion 18' of the corresponding internal leg 18. The axis of rotation 38 is coaxial with respect to the top portion 18' of the internal leg 18. Each supporting device 30 comprises a supporting member 40 having a flange 42 that slidably engages the corresponding guide 32. The supporting member 40 has a cylindrical portion 44 that is connected to a second end 46 of the arm 34 by means of a joint 48.

Figure 10:
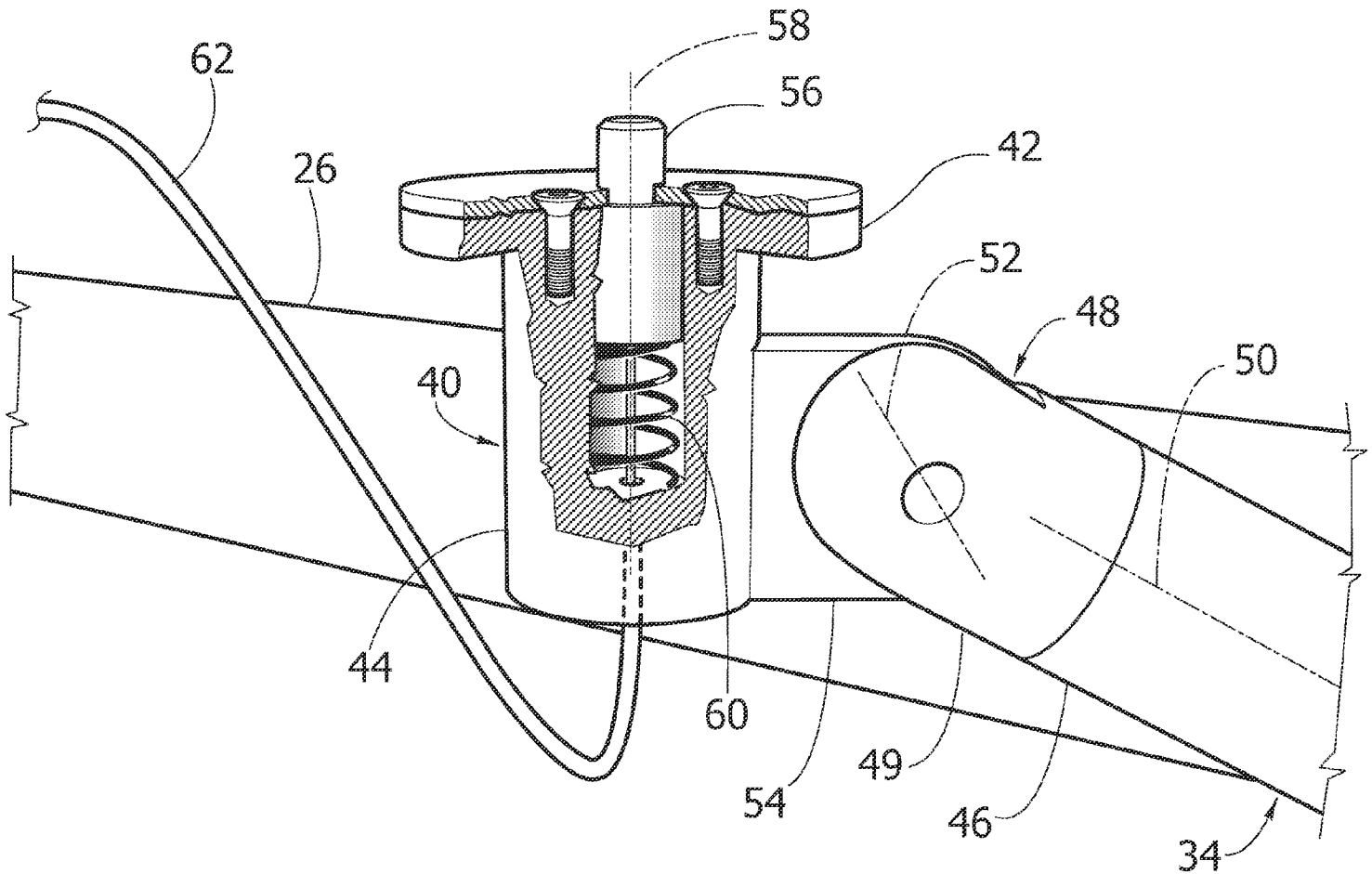
FIG. 10 is a partially sectioned perspective view of the part indicated by the arrow X in FIG. 9.

With reference to FIGS. 9 and 10, the joint 48 enables a movement of rotation of the supporting member 40 with respect to the arm 34 about two axes 50, 52 that are mutually orthogonal. The first axis of rotation 50 is coaxial to the second end 46 of the arm 34. The joint 48 comprises a body 49, which is mounted rotatable with respect to the second end 46 of the arm 34 about the axis 50. The second axis of rotation 52 is, for example, formed by a transverse pin that engages a flange 54 projecting from the cylindrical body 44 of the supporting member 40. Alternatively, the joint 48 could be constituted by a spherical joint or by any one other joint suitable for enabling a movement of rotation of the supporting member 40 with respect to the second end 46 of the arm 34 about at least two mutually orthogonal axes.

With reference in particular to FIG. 10, each supporting member 40 comprises a locking pin 56 that can slide in the direction of its own longitudinal axis 58 and is associated to a spring 60 that tends to push it outwards. In conditions of rest, one end of the pin 56 projects beyond the top surface of the flange 42. The locking pin 56 is connected to a flexible transmission cable of a Bowden type 62. As is illustrated in FIG. 8, the two transmission cables 62 are connected to a releasing device 64 provided with a handle 66 that can be actuated manually. The releasing device 64 is fixed to the underside of the top 14.

With reference to FIGS. 7 and 8, each guide 32 is provided with a top closing plate 68 which closes the guide 32 on the side facing the top 14. The plate 68 is provided with a hole 70, which is engaged by the arrest pin 56 in the position of use of the top 14.

Figure 4:
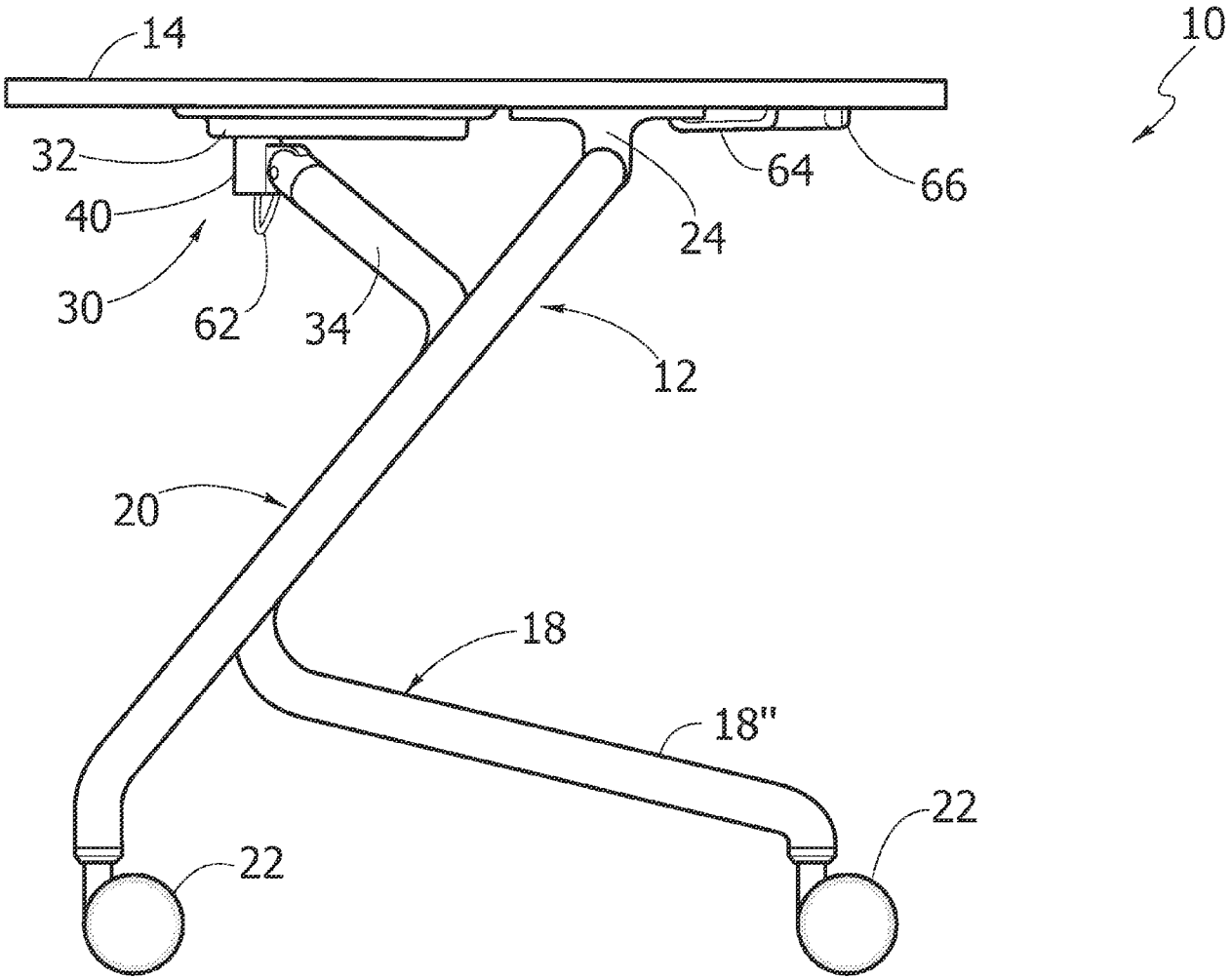
Figure 5:
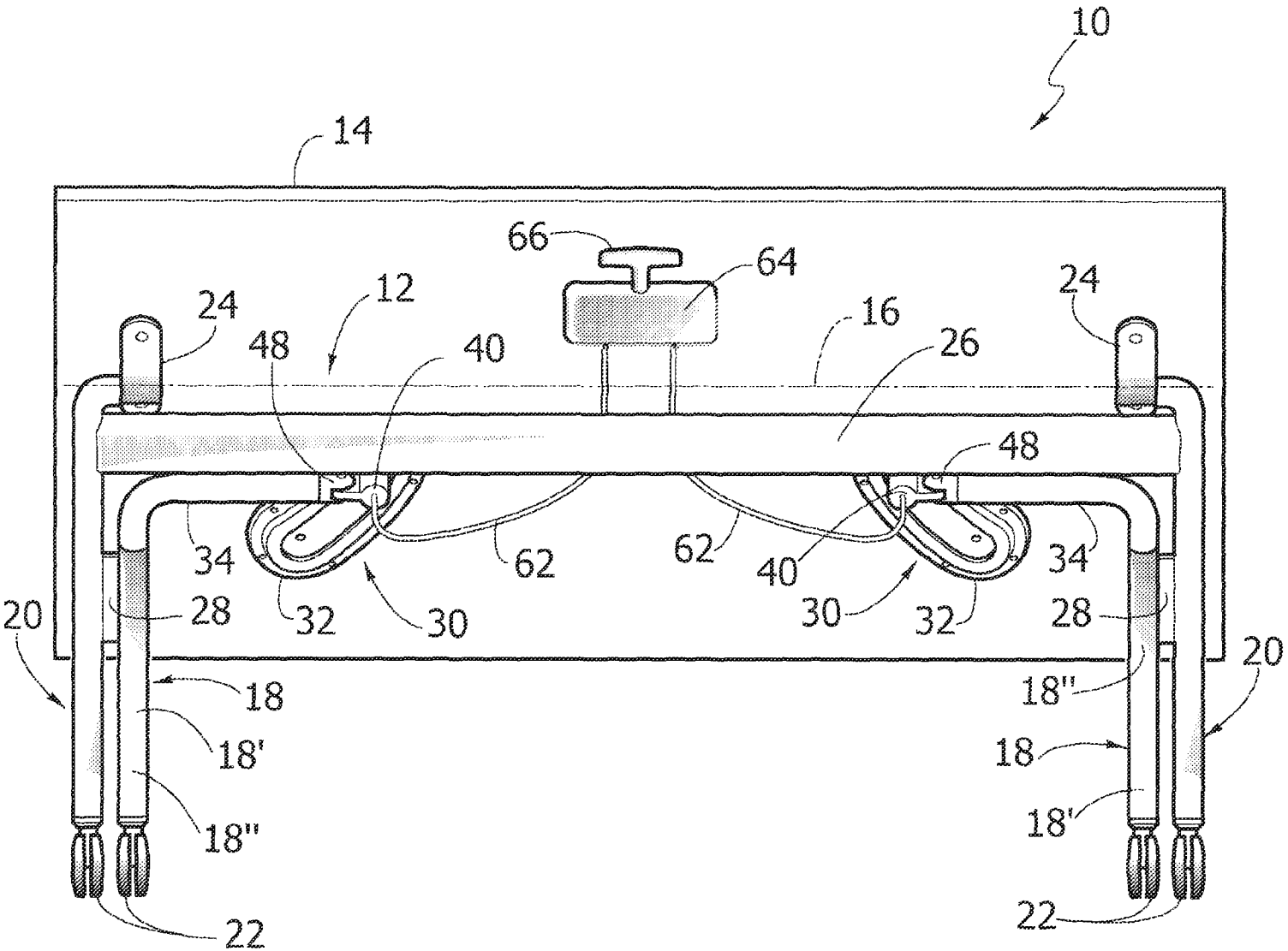
FIGS. 5 and 6 are front views illustrating the table according to the invention in a position of storage and in a position of use, respectively.
Figure 6:
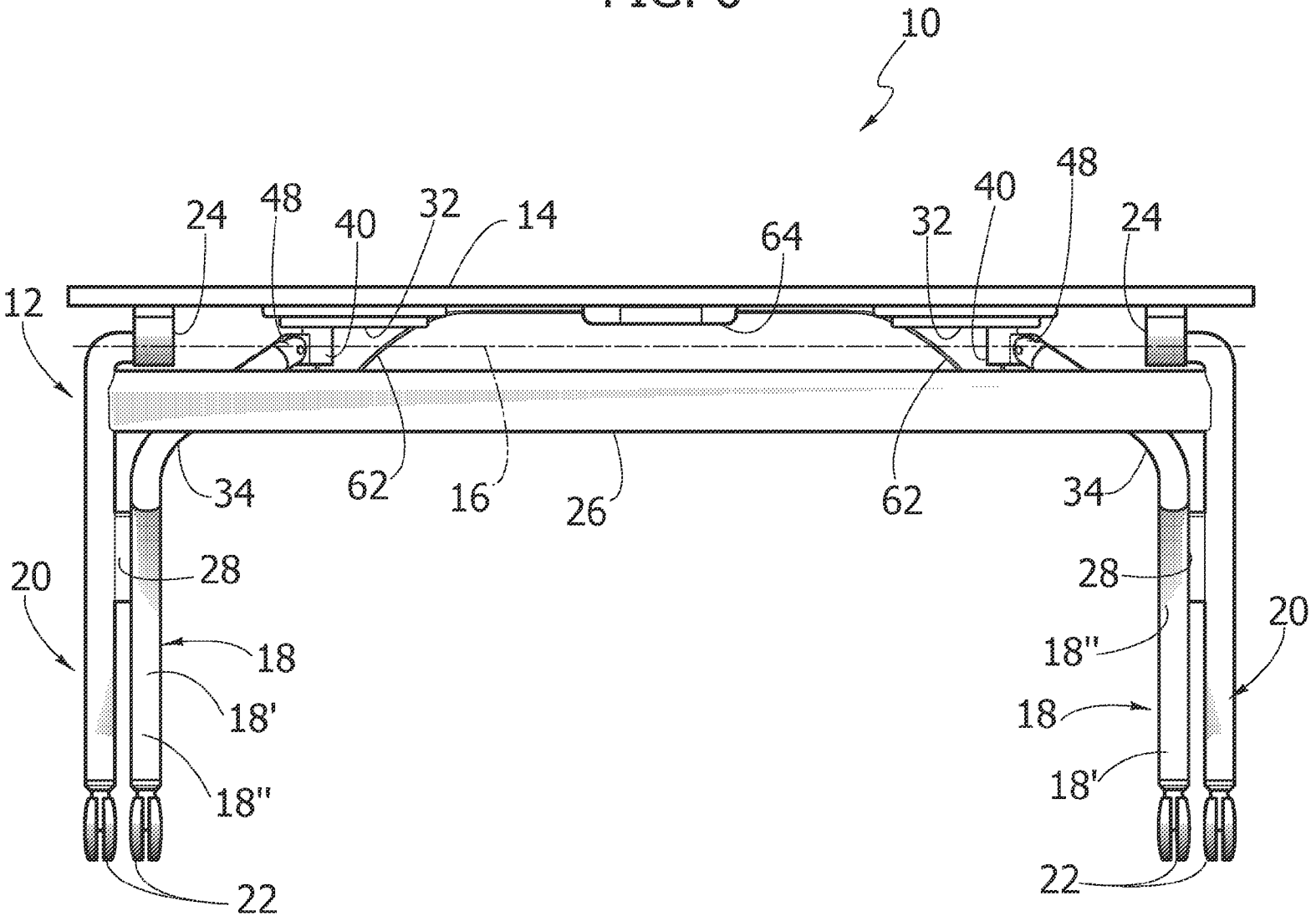

To pass from the configuration of use to the configuration of storage of the table 10, the user pulls the handle 66, disengaging simultaneously the locking pins 56 of the respective holes 70. After releasing the top 14, the user turns the top about the axis 16. During rotation of the top 14 about the axis 16, the supporting members 40 slide along the respective arched guides 32 until they reach a condition of engagement with the opposite end of the arched guide 32. This is a stable position that corresponds to the position of storage of the top 14. In this position, as illustrated in particular in FIG. 3, the top 14 extends parallel to the inclined stretches of the external legs 20. The supporting devices 30 support the top 14 both in the position of storage and in the position of use. As is illustrated in FIG. 4, in the position of use the supporting members 40 are situated at a certain distance from the axis of rotation of the top 14 and form respective supports, which are eccentric with respect to the axis of rotation 16. The weight of the top 14 would tend to bring the top 14 back into the position of storage. However, the supporting members 40 are kept in a stable position with respect to the guides 32 by engagement of the pins 56 with the respective holes 70. Consequently, the supporting devices 30 in the position of use are fixed with respect to the supporting structure 12 and sustain the weight of the top 14.

Figure 11:
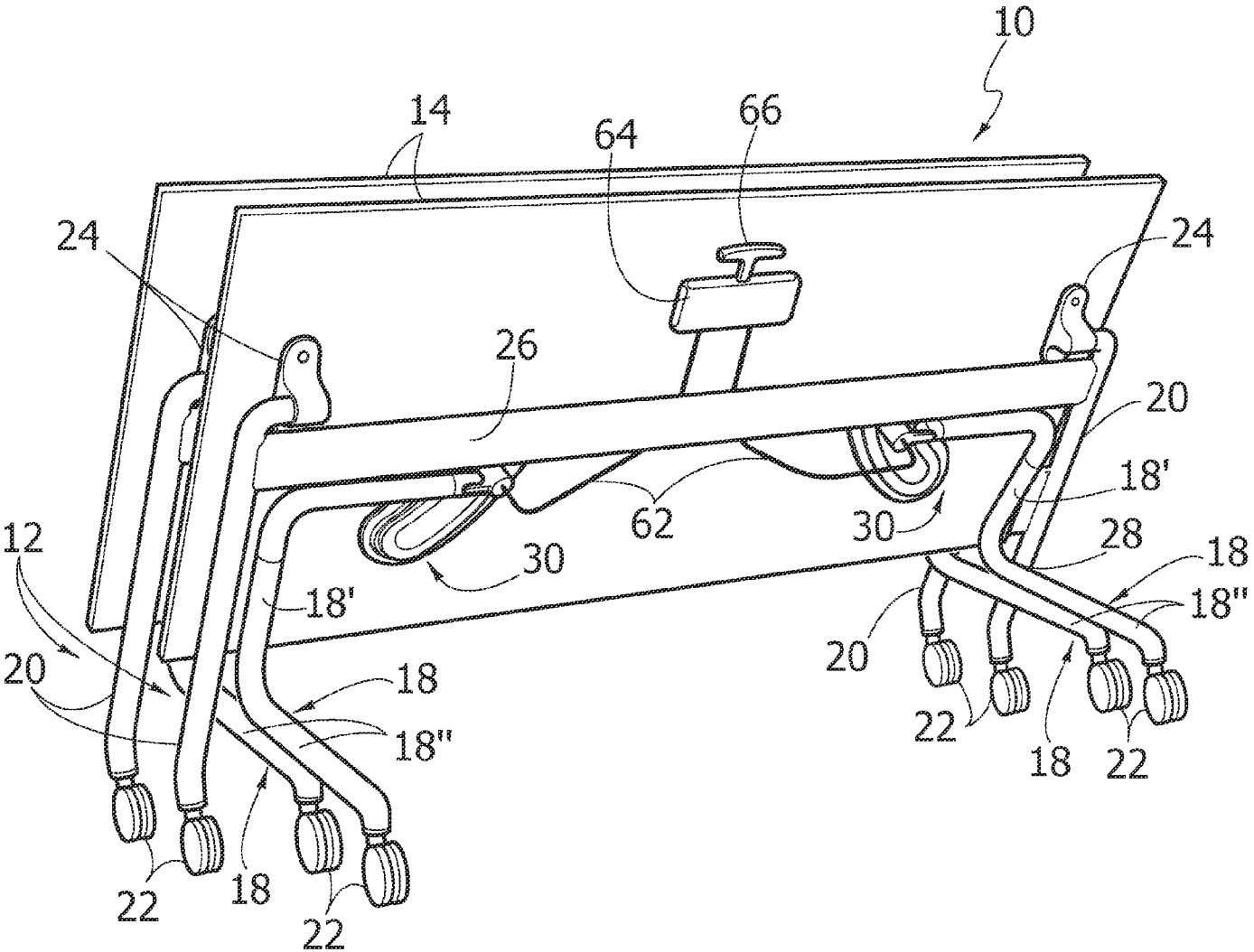
FIGS. 11 and 12 are a perspective view and a side elevation illustrating two tables according to the present invention nested in one another.
Figure 12:
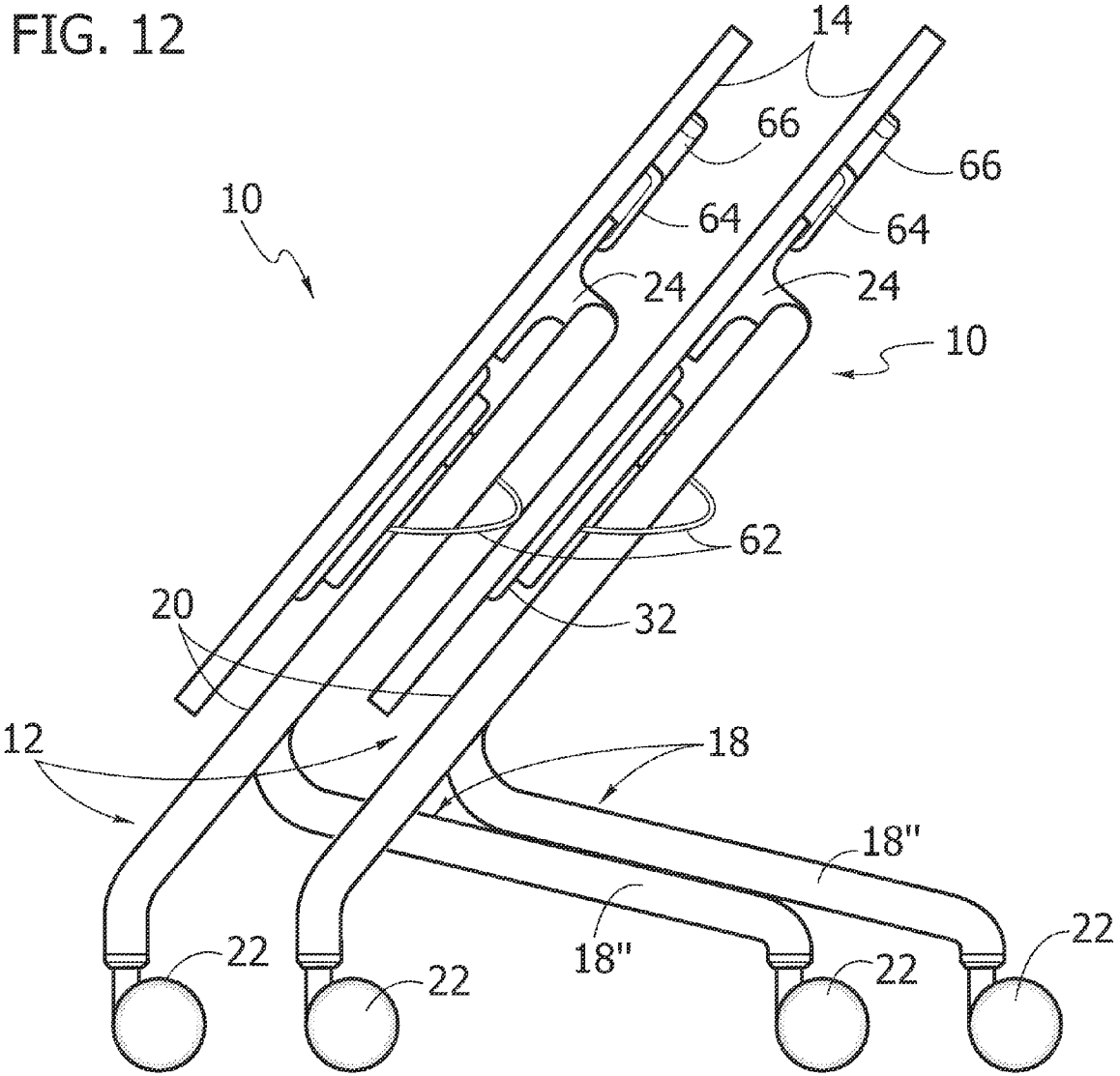

With reference to FIGS. 11 and 12, in the position of storage the table according to the present invention can be nested with other tables of the same type. In the nested position, the top 14 of two adjacent tables are parallel to one another. The portion 18" of the internal legs 18 of the rear table are situated between the external legs 20 of the table in a front position and underneath the stretches 18" of the table situated in a front position.

The shape of the legs 18, 20 of the table according to the present invention enables nesting of the tables 10, without varying the position of the legs between the position of use and the position of storage.

While the foregoing is directed to embodiments of the present invention, other and further embodiments of the invention may be devised without departing from the basic scope thereof, and the scope thereof is determined by the claims that follow.

The invention claimed is:

1. A nesting and folding table, comprising:

a supporting structure including two pairs of legs;

a top articulated to the supporting structure about a horizontal axis and mobile between a position of use and a position of storage; and a pair of supporting devices, each including an arched guide fixed with respect to the top, a rotatable arm and a supporting member, carried by the rotatable arm and slidably engaging said arched guide, wherein the first and second pairs of legs are both fixed to one another and are staggered with respect to one another in a direction parallel to the axis of rotation of the top, and wherein said arm has a first end that rotatably engages an end of a respective leg and a second end that is connected to said supporting member by means of a joint, the joint being designed to enable a movement of rotation of the supporting member with respect to said second end of the arm about at least two axes that are mutually orthogonal.

2. The table according to claim 1, wherein two external legs have respective central stretches inclined by an acute angle with respect to a vertical plane.

3. The table according to claim 2, wherein two internal legs each have a top portion and a bottom portion, in which the top portion of the legs is parallel to the inclined portion of the external legs, and wherein the bottom portion of the internal legs is inclined with respect to a horizontal plane.

4. The table according to claim 3, wherein the external legs are fixed to one another by means of a horizontal beam.

5. The table according to claim 3, wherein the inclined portions parallel to one another of the internal and external legs are fixed to one another by means of fixing elements.

6. The table according to claim 1, wherein said supporting member comprises a circular flange that slidably engages said arched guide.

7. The table according to claim 1, wherein said joint comprises a body that rotatably engages, about a first axis, an end of said arm about the first mutually orthogonal axis, said body being articulated to the supporting member about the second mutually orthogonal axis.

8. The table according to claim 1, wherein each of said supporting members comprises a locking pin that in the position of use of the top engages a hole that is fixed with respect to said arched guide.

9. The table according to claim 8, wherein said locking pins are pushed elastically towards a position of engagement and wherein there is provided a releasing device that can be actuated manually for disengaging said locking pins.

10. The table according to claim 9, wherein said releasing device is connected to said locking pins by means of two flexible transmission members of a Bowden-cable type.

11. The table according to claim 9, wherein said releasing device is fixed on an underside of said top.

* * * * *

UNITED STATES PATENT AND TRADEMARK OFFICE

CERTIFICATE OF CORRECTION

PATENT NO. : 7,765,938 B2
APPLICATION NO. : 12/033169
DATED : August 3, 2010
INVENTOR(S) : Piretti It is certified that error appears in the above-identified patent and that said Letters Patent is hereby corrected as shown below:

Column 4, Claim 1, Line 25, please delete "means of";

Column 4, Claim 4, Line 39, please delete "means of";

Column 4, Claim 5, Line 42, please delete "means of";

Column 4, Claim 7, Line 47, please delete ", about a first axis,";

Column 4, Claim 10, Line 60, please delete "means of";

Column 4, Claim 10, Line 61, please delete "of a Bowden-cable type".

Signed and Sealed this
Eighth Day of March, 2011

David J. Kappos

David J. Kappos
*Director of the United States Patent and Trademark Office*